US007228980B2

(12) United States Patent
Morini

(10) Patent No.: US 7,228,980 B2
(45) Date of Patent: Jun. 12, 2007

(54) PLASTIC CAPSULE FOR HERMETICALLY CLOSING LARGE BOTTLES

(75) Inventor: Emilio Morini, Colorno (IT)

(73) Assignee: Bormioli Rocco & Figlio S.p.A., Parma (IT)

( * ) Notice: Subject to any disclaimer, the term of this patent is extended or adjusted under 35 U.S.C. 154(b) by 163 days.

(21) Appl. No.: 10/491,591

(22) PCT Filed: May 16, 2002

(86) PCT No.: PCT/IT02/00320

§ 371 (c)(1),
(2), (4) Date: Apr. 2, 2004

(87) PCT Pub. No.: WO03/097475

PCT Pub. Date: Nov. 27, 2003

(65) Prior Publication Data

US 2004/0238476 A1 Dec. 2, 2004

(51) Int. Cl.
*B65D 39/04* (2006.01)

(52) U.S. Cl. ..... 215/253; 215/256

(58) Field of Classification Search ..... 215/253, 215/254, 256, 354, 250; 222/541.5, 541; 141/364; 206/219; 383/208
See application file for complete search history.

(56) References Cited

U.S. PATENT DOCUMENTS

| | | | | |
|---|---|---|---|---|
| 1,713,321 | A | 5/1929 | Becker | |
| 4,126,244 | A * | 11/1978 | Elser | 220/268 |
| 5,232,125 | A * | 8/1993 | Adams | 222/83.5 |
| 5,392,939 | A * | 2/1995 | Hidding et al. | 215/265 |
| 5,687,867 | A | 11/1997 | Lamoureux | |
| 5,937,921 | A | 8/1999 | Guglielmini | |
| 5,992,658 | A * | 11/1999 | Berger | 215/232 |
| 6,050,435 | A * | 4/2000 | Bush et al. | 215/250 |
| 2004/0129667 | A1 * | 7/2004 | Nusbaum et al. | 215/250 |

FOREIGN PATENT DOCUMENTS

| | | |
|---|---|---|
| EP | 0 816 283 | 1/1998 |
| EP | 1 041 035 | 10/2000 |

* cited by examiner

*Primary Examiner*—Robin A. Hylton
(74) *Attorney, Agent, or Firm*—Young & Thompson

(57) ABSTRACT

The plastic capsule, especially for large-volume bottles for use in dispensers, includes an openable zone (4) which is accessible from the outside and closed by a cap (3) is externally protected by a disc (5) which is made in a single piece with the capsule. The cap (3) is peripherally connected to the openable zone by easy-break ribs (6) and also by a thin annular skin (6*a*) which hermetically closes an annular space existing between the upper surface (1*a*) of the capsule and the disc (5).

6 Claims, 1 Drawing Sheet

PLASTIC CAPSULE FOR HERMETICALLY CLOSING LARGE BOTTLES

TECHNICAL FIELD

The invention relates to a plastic capsule for large bottles with high capacity, destined to be used in drinks dispensers.

BACKGROUND ART

The prior art has for a considerable time taught large bottles (usually 20 liters) containing water, which are inserted in water dispensers having a tap valve. In order to be usable with various types of dispenser, however, these bottles have to be of standard shape and size, especially as regards their mouths.

These bottles are generally closed by a single-use capsule, usually made of plastic, which has an opening zone that is accessible from the outside, so that at the moment when the bottle is inserted in the distributor a spout of the dispenser is also inserted, enabling the water in the bottle to be accessed. The openable zone is normally located in the centre of the capsule, and is closed by a cap which is pushed into the bottle itself by the spout when the bottle is inserted in the dispenser. The openable zone of the bottle capsule is externally protected by a guard, usually a cover or a thin paper or plastic disc glued onto the upper part of the capsule, which is removed before inserting the bottle in the dispenser. Internally of the capsule there is a seal disc which, when the capsule is inserted on the bottle, stays at the bottle mouth to guarantee a seal.

Some examples of these known capsules are described in EP 0816283, U.S. Pat. No. 5,687,867, U.S. Pat. No. 5,123,555 and U.S. Pat. No. 5,222,530.

When making these capsules, which are produced and used in considerable numbers, it is extremely important to limit the unit cost of production. For this reason it is extremely important to limit the number of pieces necessary for manufacturing the capsule, and the quantity of material necessary for realising the various pieces thereof.

The main aim of the present invention is to provide a capsule having a limited number of pieces and which uses a limited quantity of material for realising the various pieces, thus considerably reducing manufacturing costs.

An advantage of the present invention is that it provides a capsule which is extremely easy to use.

A further advantage of the present invention is that it provides a capsule which can be used on standard-sized bottles.

These aims and advantages and more besides are all attained by the capsule of the invention, as it is characterised in the claims that follow.

DISCLOSURE OF INVENTION

Further characteristics and advantages of the present invention will better emerge from the detailed description that follows of a preferred but non-exclusive embodiment of the invention, illustrated purely by way of a non-limiting example in the accompanying figures of the drawings, in which.

Figure 1:
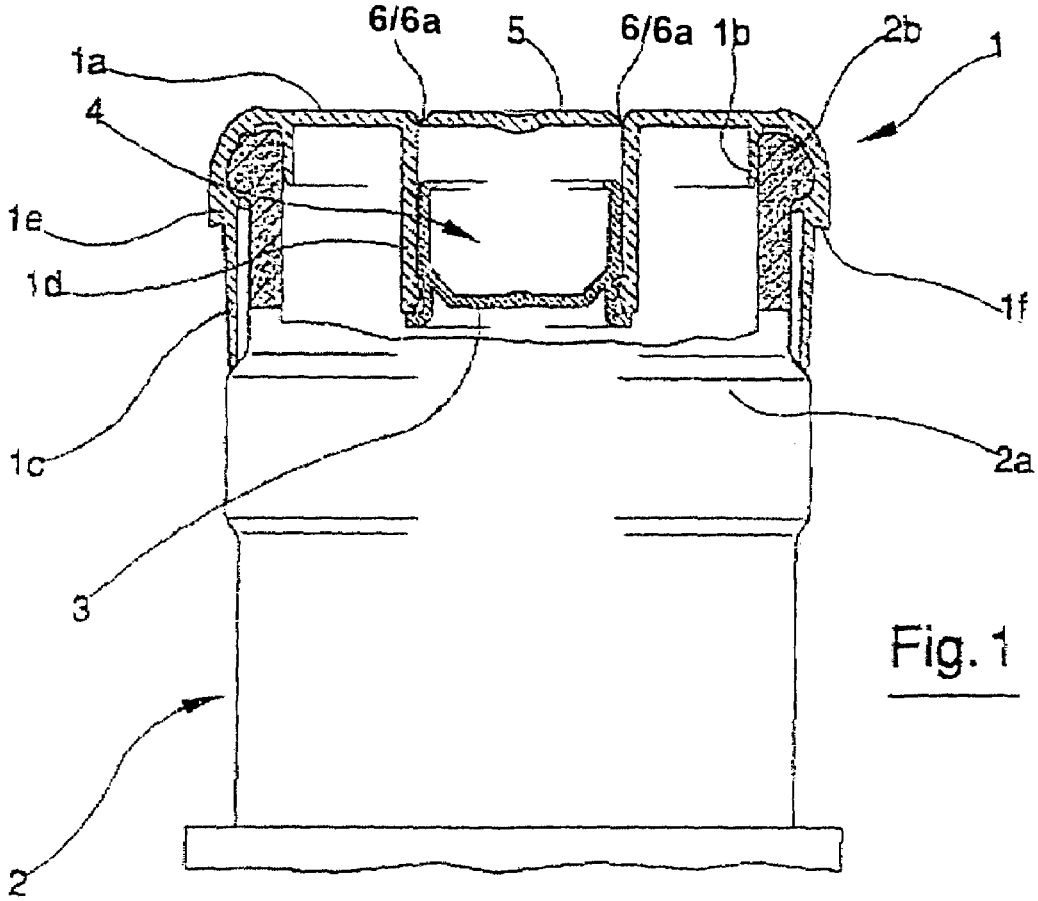
FIG. 1 is a section in vertical elevation of the capsule of the invention applied on a large bottle illustrated partially and with some parts removed.
Figure 2:
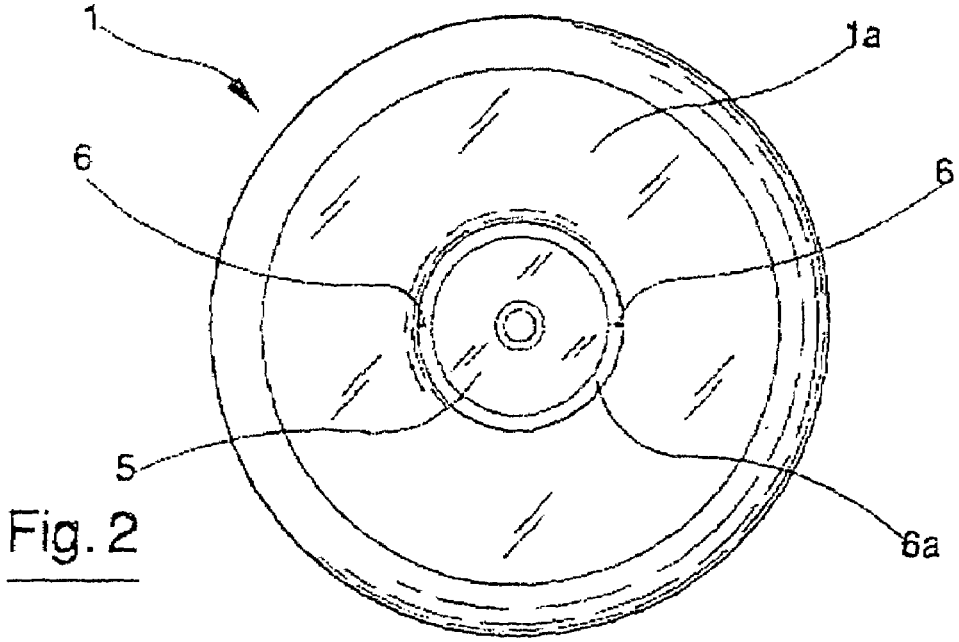
FIG. 2 is a view from above of the capsule of FIG. 1.

In the figures of the drawings, 1 denotes a capsule destined to be used for closing large bottles 2, normally with a 20-liter capacity and destined to contain water. The bottles are inserted in special distributors which dispense water through a tap valve. In order to be inserted in the various types of distributors, the bottles are of a standard size and shape, especially around the area of their mouths, which exhibit a cylindrical annular projection 2*a* fashioned on the neck of the bottle at a predetermined distance from the mouth of the bottle, and a specially-shaped external annular projection 2*b* made on the external surface of the bottle 2 close to the mouth. Both the cylindrical annular projection 2*a* and the external annular projection 2*b* have standard locations and dimensions in the various bottles. As with known capsules of this type, the capsule of the invention comprises an openable zone 4 which is delimited by a cylindrical wall 1*d* which projects coaxially and internally of the capsule from the upper surface 1*a* of the capsule itself.

The openable zone 4 is, as will be described in more detail herein below, accessible from the outside. The openable zone is inferiorly closed by a cap 3 which is inserted sealingly in the cylindrical wall 1*d*. Water is removed through the openable zone 4, as will be better described herein below.

The capsule of the invention comprises a protection element for the openable zone 4 which in turn comprises a disc 5 which is fashioned superiorly of the openable zone 4 and made in a single piece with the capsule. The disc 5 is peripherally connected with the opening of the openable zone 4 by means of easy-break ribs 6, and is coplanar to the upper surface 1*a* of the capsule. For reasons that will be better explained herein below, two opposite ribs are preferable as illustrated in the figure of the drawings, though three could also be provided.

To complete the protection of the openable zone, the protection element of the capsule further comprises a thin annular skin 6*a* which is made in a single piece with the capsule during its injection-forming. The skin 6*a* is much thinner than the upper surface 1*a*, the disc 5 and the ribs 6. The skin 6*a* provides a hermetic closure of the annular space between the upper surface 1*a* of the capsule and the disc 5. As the capsule 1 is made by injection-moulding for food use, the thin annular skin 6*a* is manufactured as a sort of fin or burr, which is very easily obtained by leaving, in the zone corresponding to the annular skin 6*a*, a slight distance between the upper die and the lower die used for making the capsule.

The capsule of the invention also comprises an internal hoop 1*b* which is fashioned internally of the capsule 1 and coaxially thereto. The internal hoop 1*b* projects from the internal surface of the capsule 1 and is so dimensioned as to fit sealingly internally of the mouth of the bottle 2 when the capsule 1 is inserted on the bottle. The internal hoop 1*b* is obtained directly during the moulding of the capsule, and guarantees the seal of the capsule, eliminating the need for seal discs internally of the capsule.

The capsule further comprises an internal annular projection 1*e* which is internally fashioned on the capsule 1; the annular projection 1*e* defines, with the internal annular hoop 1*b*, a seating in which, when the capsule is inserted on the bottle, the external annular hoop 2*b* made on the external surface of the bottle neck 2 inserts. In this way a good and solid grip of the capsule on the bottle neck 2 is obtained.

The upper part of the capsule has a slightly larger diameter than the diameter of the external hoop 1*c* and defines, in the connection zone between the external hoop 1*c* and the upper part of the capsule, an annular projection 1*f* having a hook-shape. This resulting hook means that the capsule is easily gripped by known-type machines typically used in bottling plants.

The capsule of the invention is press-inserted on the bottle in the bottling plant. Up until moment of use, the capsule remains solidly anchored to the bottle and its removal is particularly difficult because the external hoop 1*c* constitutes a sort of single surface with the external surface of the annular projection 2*a* of the neck of the bottle, making a manual extraction (even using tools) of the capsule from the bottle difficult.

The openable zone 4, which as in known capsules is inferiorly sealingly closed by the cap 3, is protected superiorly by the disc 5 and the annular skin 6*a* which completely close the openable zone 4, preventing any external agents such as dust or the like from penetrating inside the capsule.

Furthermore, the bottle cannot be opened without signal thereof due to the presence of the easy-break ribs 6 and the skin 6*a*, which constitute a sort of anti-tamper security device. Note that, both the protection in the openable zone and the security device are obtained directly during the manufacturing of the capsule, without any need, as there is in known capsules, to add further elements, such as glued-on discs and the like.

When in use, the disc 5 is manually removed; the operation is particularly easy because, following a slight pressure, the disc 5 rotates around the ribs, after rupturing the thin skin 6*a*, and can therefore be gripped by hand and pulled to break the ribs.

Thereafter, as happens with known capsules, a spout is introduced into the openable zone of the capsule, which, after having pushed the cap 3 into the bottle, penetrates into the bottle and enables the water to be removed. Note that the cap 3 exhibits no contamination from external agents because, up until the moment of use, the cap 3 is hermetically protected.

When the empty bottle is returned to the bottling plant, removal of the old capsule is made extremely easy by virtue of the presence of the annular projection 1*f* which enables the capsule to be easily gripped by the handling machines.

The invention claimed is:

1. A plastic capsule for closing a large bottle, said capsule comprising:

an upper surface;

a cylindrical wall projecting coaxially from below said upper surface to form an openable zone that is accessible from outside said capsule and through which a liquid contained in a large bottle may be removed;

a cap closing said openable zone at the end of said cylindrical wall opposite said upper surface;

a disc being located above said openable zone, coplanar to said upper surface, made in a single piece with said capsule, and peripherally connected to said cylindrical wall of said openable zone by easy-break ribs such that an annular space is defined between said disc and upper surface;

an annular skin hermetically sealing said annular space, wherein said annular skin is made in a single piece with said capsule and is formed thinner than said disc and said ribs such that said skin is rupturable; and an external annular hoop forming an outer lateral wall of said capsule extending coaxially below said upper surface and having a larger diameter than said cylindrical wall, wherein said external annular hoop rests on an annular projection of a neck of a bottle when said capsule is mounted on a bottle, said external annular hoop rests on said annular projection in such a way so as not to project laterally from said neck.

2. The capsule of claim 1, further comprising:

an internal annular hoop located internally and coaxially of said capsule that projects from an internal surface of said capsule, wherein said internal annular hoop inserts sealingly internally with a mouth of a bottle when said capsule is mounted to a bottle.

3. The capsule of claim 2, further comprising:

an internal annular projection located internally of said capsule, wherein said internal annular projection and said internal annular hoop define a seating in which an external annular projection from an external surface of a bottle neck inserts when said capsule is mounted on a bottle.

4. The capsule of claim 1, further comprising:

an upper part extending coaxially below said upper surface and having a diameter greater than said external annular hoop;

a connection zone between said upper part and said annular hoop where said upper part and annular hoop connect; and a hooked shape section in said connection zone, wherein said hook-shape section provides an easy grip location for a bottling machine.

5. The capsule of claim 1, wherein said capsule is manufactured by injection-moulding, and is made of plastic for use with foodstuffs.

6. The capsule of claim 1, wherein said easy-break ribs are two ribs located in diametrically opposed positions of said disc.

* * * * *